United States Patent [19]

Main et al.

[11] 4,173,138

[45] Nov. 6, 1979

[54] CAN BODYMAKER HAVING IMPROVED RAM SUPPORT AND DRIVE

[75] Inventors: Ralph M. Main, San Pedro; Elpidifor Paramonoff, Los Angeles, both of Calif.

[73] Assignee: Standun, Inc., Compton, Calif.

[21] Appl. No.: 846,420

[22] Filed: Oct. 28, 1977

[51] Int. Cl.[2] ..... B21D 22/28

[52] U.S. Cl. ..... 72/349; 72/449; 308/5 R

[58] Field of Search ..... 72/346, 347, 348, 349; 308/5 R

[56] References Cited

U.S. PATENT DOCUMENTS

| | | | |
|---|---|---|---|
| 3,270,544 | 9/1966 | Moeder et al. | 72/346 |
| 3,466,951 | 9/1969 | Greenberg | 308/5 R X |
| 3,635,532 | 1/1972 | Zerbula | 308/5 R |
| 3,663,072 | 5/1972 | Cvacho | 308/5 R |
| 3,735,629 | 5/1973 | Paramonoff | 72/349 |
| 3,985,061 | 10/1976 | Montgomery | 308/5 R X |

FOREIGN PATENT DOCUMENTS

| | | | |
|---|---|---|---|
| 310935 | 1/1956 | Switzerland | 308/5 R |

*Primary Examiner*—Leon Gilden

*Attorney, Agent, or Firm*—Mahoney, Schick & Cislo

[57] ABSTRACT

A horizontally reciprocal ram is movably supported on a can bodymaker for forward and rearward movement of a ram forward end through a die assembly by stationary, spaced, hydrostatic oil bearing sleeves located rearwardly of the die assembly thereby isolating at least a major portion of the ram for support and alignment for remainder of the bodymaker. Drive mechanism supplying horizontal ram drive to a ram rearward end may include a movable hydrostatic oil bearing slide connected to the ram through various optional forms of drive connection means supplying varying degrees of relative flexibility between the ram and slide to thereby determine the degree of ram isolation by the bearing sleeves with an optimum of substantially full ram isolation. Included in certain of the drive connection means providing greater flexibility for greater ram isolation are variously located hydrostatic oil bearing pad assemblies.

18 Claims, 23 Drawing Figures

CAN BODYMAKER HAVING IMPROVED RAM SUPPORT AND DRIVE

BACKGROUND OF THE INVENTION

This invention relates to a can bodymaker having improved ram support and drive wherein a horizontally reciprocal ram having a forward end portion moving forwardly and rearwardly through a die assembly carrying a metal can blank forwardly therewith for performing can forming operations, and which ram was formerly supported and maintained aligned in its reciprocations between a moving rearward end connected drive mechanism and a more forwardly stationary bearing sleeve, is uniquely now isolated for such support and alignment between two, more centrally located, both stationary bearing sleeves. Thus, this unique ram isolation relegates the formerly ram supporting drive mechanism to the primary function of merely transmitting drive to the ram. The overall result is that the ram is much more simply, but with improved operating efficiency, supported and maintained aligned by the non-moving bearing sleeves while eliminating certain massive drive mechanism moving components formerly required for their supporting function and the speed of the ram strokes may be appreciably increased, if desired, while using the equivalent or less driving power, resulting in a faster and more efficiently operating overall can bodymaker.

Various forms of metal can bodymakers have heretofore been provided and that which is most closely analagous to the can bodymaker containing the improvements of the present invention includes a horizontally reciprocal ram which is movably supported in its reciprocal strokes by or between a ram rearward end connected drive mechanism constantly moving with the ram and a more forwardly positioned bearing sleeve secured stationary on the bodymaker. More specifically, various gears, crank arms, drive arms and rods of the bodymaker transform rotative motion into horizontally reciprocal or horizontally forward and rearward motion within the bodymaker drive mechanism, the drive mechanism motion finally culminating in a relatively massive, horizontally forwardly and rearwardly moving hydrostatic oil bearing slide. The rearward end of the ram is supported on and driven forwardly and rearwardly by this hydrostatic oil bearing slide with, as previously stated, the forward point of support for the ram being a bearing sleeve, particularly a hydrostatic oil bearing sleeve, secured stationary on the bodymaker and receiving, supporting and guiding the ram moving therethrough. A forward end portion of the ram receives a shallow metal cup blank thereover at a location forwardly of the bearing sleeve and when the ram is at the rearward end of and is just commencing its forward stroke, with the ram in continuing forward movement carrying the cup blank forwardly through a die assembly to form the cup blank into a relatively deep, cup-shaped can body, overall generally in the usual manner of can bodymakers.

Thus, in this prior bodymaker, the ultimately forward terminus of the bodymaker drive mechanism which is the hydrostatic oil bearing slide must not only move with and provide driving motion to the rearward end of the ram in all positions of the ram, but must also fully support and fully maintain alignment of the ram with both the more forward bearing sleeve and the even further more forward die assembly. Obviously, the only two points of support for the ram and that required to maintain the ram in alignment with the die assembly in all positions of the ram are the slide at the rearward end and the sleeve forwardly thereof, the constantly moving slide required to move with the ram progressively decreasing the distance between it and the bearing sleeve during forward motion of the ram and movably increasing such distance during rearward movement of the ram. Due to this complex requirement of drive transmission, ram rearward end full support and maintaining of alignment over constantly changing distances relative to the bearing sleeve, the slide must necessarily be relatively massive with complex moving support on the bodymaker extending over a relatively large stabilizing distance in the direction of ram projection. Furthermore, the slide for the optimum possible results in this relatively complex arrangement has made use of a relatively large number of hydrostatic oil bearing pads at various locations between it and its supporting bodymaker, again increasing complexity.

In overall result, although the described prior complex bodymaker ram movable support has produced satisfactory operating characteristics within even quite impressive speed limitations, even better operating characteristics are now desirable and even higher operating speeds required. Furthermore, it is desirable to greatly reduce the complexity of this ram support despite the requirement for attainment of higher speeds in order to reduce the cost of original bodymaker fabrication, as well as the cost of original and continuing assembly and maintenance for maintaining the necessary ram constantly closely aligned movements. For these reasons, an improved ram support and alignment concept is required which will surmount the above discussed limitations of the prior construction while meeting the described increased results.

OBJECTS AND SUMMARY OF THE INVENTION

It is, therefore, an object of this invention to provide a can bodymaker having an improved ram supporting drive wherein a horizontally reciprocal ram having a forward end portion movable forwardly and rearwardly through a die assembly in the performance of metal can forming operations is isolated for its movable support and alignment with the die assembly primarily by spaced bearing sleeves stationary on the bodymaker, thereby relegating a moving drive mechanism operably connected to the rearward end of the ram to the task of primarily providing forward and rearward motion to the ram. With the ram supporting bearing sleeves being stationary on the bodymaker so as to always remain a constant distance apart and at set locations, the provision of the ram alignment and movable support may be accomplished in a more efficient and simple manner, far superior over the prior constructions making use of at least one ram moving support, for instance, of the type hereinbefore discussed. Furthermore, with the functioning of the drive mechanism operably connected to the rearward end of the ram being reduced to primarily forward and rearward motion for the ram and primarily eliminating therefrom any ram support requirement, the drive mechanism, at least at its terminus at the ram rearward end may be of a simplified nature eliminating the complexities hereinbefore discussed relative to the prior constructions.

As an example and according to one preferred embodiment of the present invention, the horizontally reciprocal ram is supported at a location rearwardly of the die assembly by spaced, stationary, hydrostatic oil bearing sleeves, each having oil bearing pads supporting the ram movable forwardly and rearwardly therein while maintaining the ram aligned with the die assembly during such movement. The drive mechanism includes a hydrostatic oil bearing slide operably connected to the ram rearward end and movable forwardly and rearwardly with the ram, the hydrostatic oil bearing slide being greatly modified from those of the prior constructions and hereinbefore discussed. With the unique hydrostatic oil bearing sleeve support for the ram, the majority of the ram is isolated for its support and alignment from the drive mechanism including the hydrostatic oil bearing slide so that the primary purpose of the slide is to provide forward and rearward motion for the ram.

It is a further object of this invention to provide a can bodymaker having an improved ram support and drive of the foregoing general character wherein the degree of isolation of the ram from the drive mechanism may be uniquely controlled from at least the isolation of the majority of the ram up to and including full ram isolation from its drive mechanism. According to certain of the embodiments of the present invention, a drive connection means between the rearward end of the ram and the drive mechanism may be of simpler form providing at least the majority ram isolation, while in other embodiments of the present invention, the drive connection means may be formed as a universal drive connection means providing substantially full ram isolation as to support and alignment and except for forward and rearward driving forces, all as desired or required for the particular construction. Also, with any of the embodiments chosen, the forward end of the drive mechanism may include the previously discussed hydrostatic oil bearing slide to which the rearward end of the ram is operably connected by the particular drive connection means.

It is still a further object of this invention to provide a can bodymaker having improved ram support and drive of the foregoing general character wherein the reduction of the massiveness of that portion of the drive mechanism operably connected to the ram rearward end due to the isolation of the ram to its spaced bearing sleeves for its support and alignment permits the ram movement at the same speed with the use of less power or markedly increased ram speeds with the use of the same power. Furthermore, due to the respective support relationships between the various bodymaker improved components, durability of high speed operation is increased so as to reduce maintenance and replacement requirements. The overall result is, therefore, that of a reduction in bodymaker cost per unit produced over a longer servicable bodymaker life, the prime attributes required of modern, mass production machines.

It is also an object of this invention to provide a can bodymaker having improved ram support and drive of the foregoing general character wherein the isolation of the ram for its support and alignment from the drive mechanism, now primarily required to merely provide forward and rearward motion to the ram, permits a major simplification of the drive mechanism and particularly that portion thereof approaching its operable connection to the ram rearward end. As hereinbefore pointed out, where the drive mechanism includes an oil bearing slide operably connected to the ram rearward end, the oil bearing slide may be greatly modified from that used by the prior constructions described since this oil bearing slide, due to the ram isolation, is no longer required to rearwardly support the ram during its movement therewith, but is only primarily required to transmit forward and rearward driving forces to the ram. For these same reasons, the drive mechanism, whether making use of the oil bearing slide or otherwise, is less critical as to its own alignments having any appreciable effect on the ultimate ram alignment, particularly where the drive mechanim is operably connected to the ram rearward end by the more sophisticated and more completely ram isolating drive connections. Thus, less critical alignment structures may be tolerated in the drive mechanism than has heretofore been possible in the prior constructions while still not affecting the required closely aligned ram movements, again permitting cost reductions in drive mechanism construction.

Other objects and advantages of the invention will be apparent from the following specification and the accompanying drawings which are for the purpose of illustration only.

DESCRIPTION OF THE BEST EMBODIMENTS CONTEMPLATED

Figure 1:
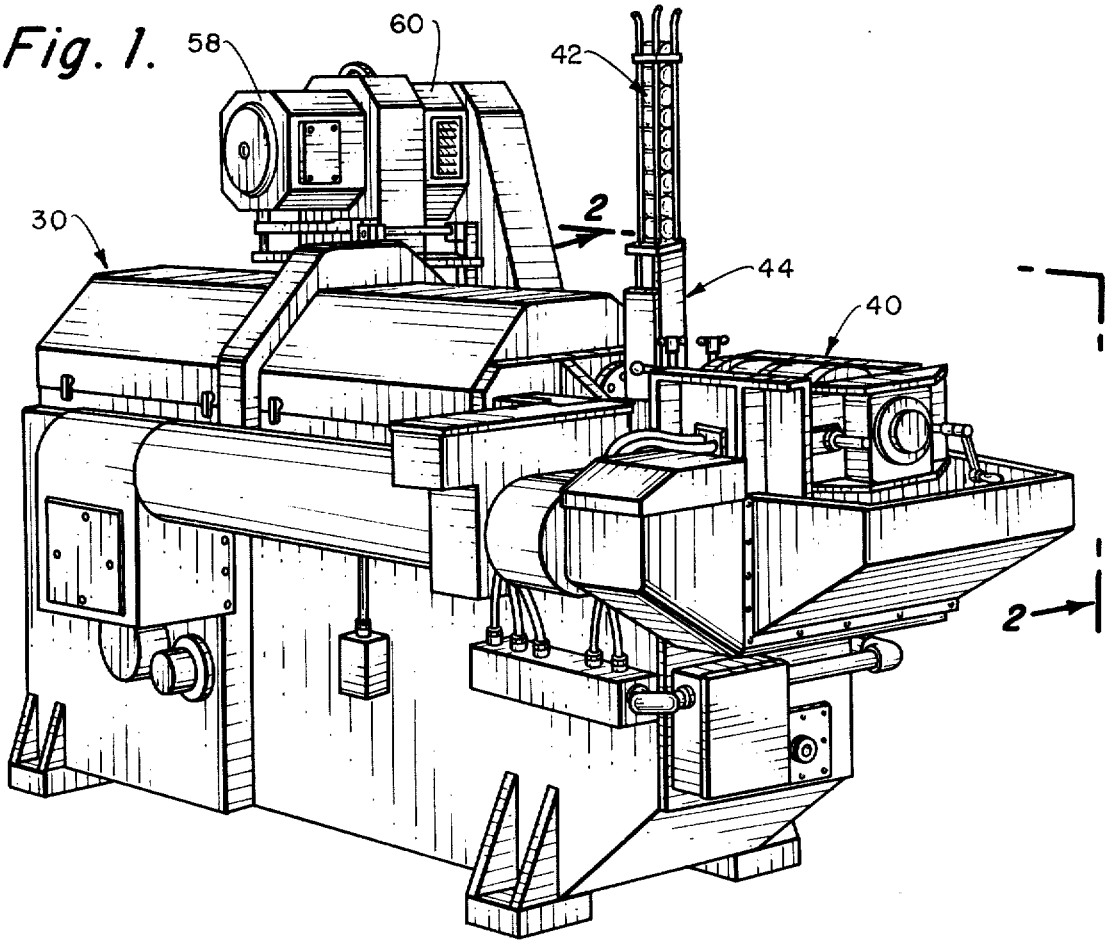
FIG. 1 is a perspective view of a somewhat typical metal can bodymaker incorporating the ram support and drive improvements of the present invention.
Figure 2:
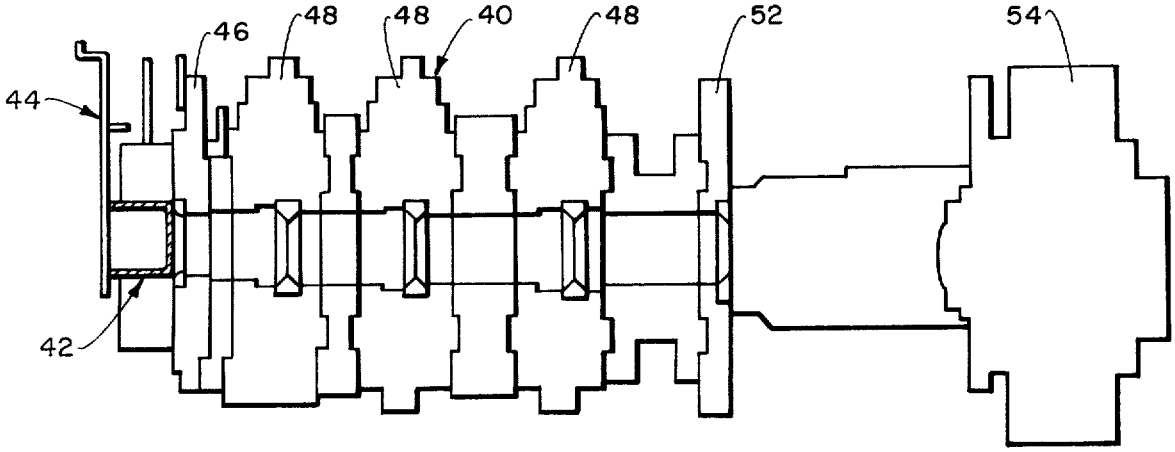
FIG. 2 is an enlarged, somewhat diagrammatic, vertical sectional view of the die assembly of the bodymaker of FIG. 1 looking in the direction of the arrows 2—2 in FIG. 1.

Referring to FIGS. 1 through 13 of the drawings, a somewhat typical metal can bodymaker is shown generally indicated at 30 incorporating first embodiment constructions of the ram support and drive improvements of the present invention. In function, the metal can bodymaker generally receive shallow metal cup blanks and forms such blanks, one at a time, into relatively deep cup-shaped can bodies, present bodymakers operating at the rate of forming 125 to 175 finished can bodies per minute, accurately and uniformly reducing metal can body walls from 13 to 4½ thousandths thickness. It is pointed out out that the specific overall bodymaker 30 illustrated and briefly described herein is for purposes of typical environment for the ram support and drive improvement of the present invention and that it is not intended by such illustration to limit the principles of the present invention to the specific bodymaker shown. Furthermore, the bodymaker 30 or any other bodymaker incorporating the principles of the present invention may be formed of usual materials by usual fabrication processes, all well known to those skilled in the art.

Still generally, the bodymaker 30 includes a drive mechanism generally indicated at 32 which produces rotative forces and converts such rotation into generally horizontal lineal forces or generally horizontal, forward and rearward, reciprocal strokes. The drive mechanism 32 is operably connected to a rearward end 34 of a horizontally reciprocal ram generally indicated at 36 for driving a forward end portion 38 of the ram forwardly and rearwardly through an appropriate die assembly generally indicated at 40. Briefly for the moment, when the ram 36 is withdrawn fully rearwardly by the drive mechanism 32 spaced rearwardly of the die assembly 40 and is just beginning its forward stroke, a forwardmost of a series of shallow metal cup blanks generally indicated at 42 being fed by a bodymaker cup blank infeed generally indicated at 44 is telescoped over the ram forward end portion 38 by this ram forward movement.

As probably best seen in FIGS. 2 through 6, continued forward movement of the ram 36 continuing its forward stroke carries the shallow cup blank 42 through a redraw die 46 of the die assembly 40, if provided depending on the blank material, and a series of ironing dies 48 to form the shallow cup blank into a relatively deep cup-shaped can body 50, increased in length and reduced in diameter. The can body 50 is then continued to be carried rearwardly by the forward end portion 38 of the ram 36 through a stripper 52, not effectively actionable during can body rearward movement, and against an end or bottom forming die 54 at which time the ram reverses into the start of its rearward stroke ultimately carrying the can body back into engagement with the stripper where the can body is stripped from the ram forward end portion and drops downwardly to an outfeed generally indicated at 56. Completing one reciprocating cycle, the ram 36 continues to be withdrawn through the die assembly 40 by the drive mechanism 32 in the ram rearward stroke and ultimately completes the same spaced rearwardly of the die assembly, reversing to begin its next forward stroke.

More specifically to the drive mechanism 32 and ultimately to its direct involvement with the improved ram support and drive principles of the present invention, as shown in FIG. 1, the drive mechanism includes an electric drive motor 58 transmitting rotative drive through a usual variable speed drive 60, through usual belting (not shown) and to a fly wheel (not shown) mounted on a main drive shaft 62. The main drive shaft 62, in turn, rotates a pair of spaced drive gears 54 rotatably engaged with a pair of spaced bull gears 66. The bull gears 66 at the facing sides thereof each have a crank arm 68 secured thereto, the outer ends of which support a crank pin 70 therebetween rotatably received through the rearward end of a transfer arm 72.

The forward end of transfer arm 72 is pivotally connected by a crank pin 74 to the general midpoint of a bifurcated drive arm 76, the lower end of which is pivotally supported on the bodymaker 30. Thus, through the various components of the drive mechanism 32 thus far described, the starting rotational motion of the electric drive motor 58 is transformed into the forward and rearward pivotal motion of the drive arm 76 and the upper end of the drive arm, although moving forwardly and rearwardly in an arcuate path, does describe generally horizontal forward and rearward reciprocal strokes. Furthermore, up to this point thus far described in the drive mechanism 32, all of the elements are appropriately supported in their described motions by usual bearings and well known usual manner.

Figure 8:
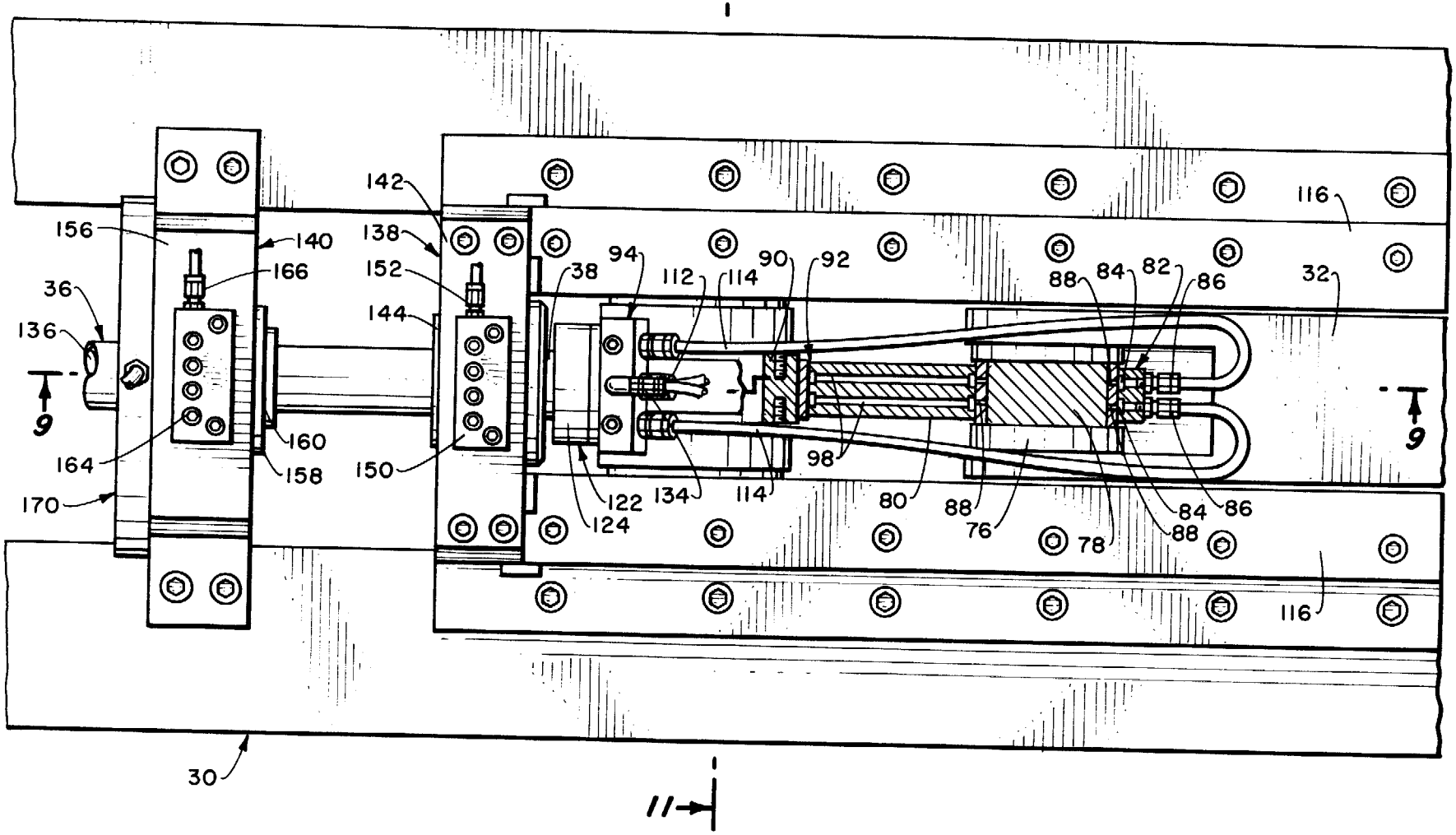
FIG. 8 is an enlarged, fragmentary, horizontal sectional view looking in the direction of the arrows 8—8 in FIG. 5.
Figure 9:
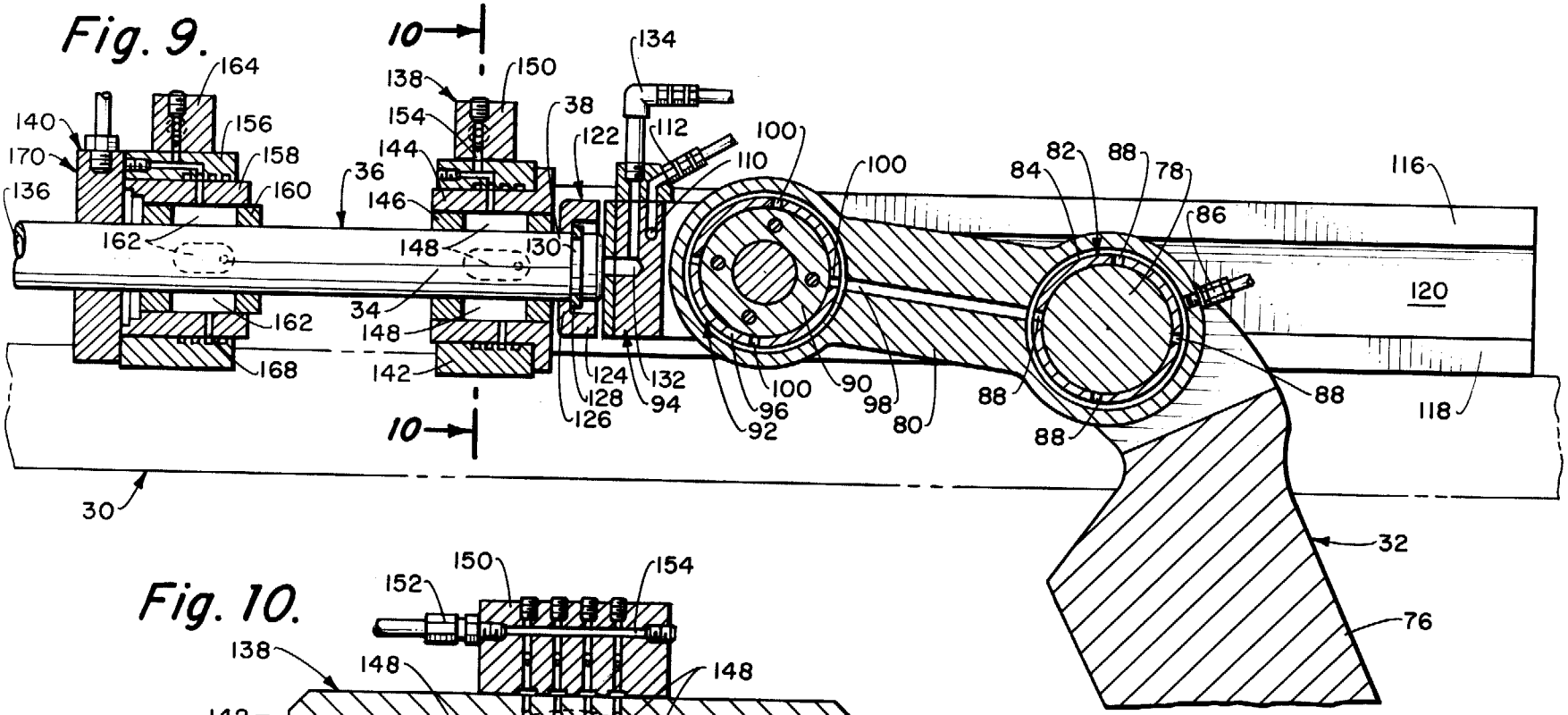
FIG. 9 is a fragmentary, vertical sectional view looking in the direction of the arrows 9—9 in FIG. 8, the drive mechanism being shown incorporating a first embodiment of an oil bearing slide and the drive mechanism being operably connected to the ram through a first embodiment of a drive connection means between the oil bearing slide and the ram.

Continuing with the drive mechanism 32, the upper end of the drive arm 76 secures a connecting pin 78 which is received through a rearward end of a drive rod 80 with pivotal motion therebetween established through a hydrostatic oil bearing assembly generally indicated at 82 as best seen in FIGS. 8 and 9. The hydrostatic oil bearing assembly 82 is formed in the drive rod 80 merely making use of the outer cylindrical surface of the connecting pin 78 and is comprised of transversely spaced, annular, pressurized oil distribution channels 84 which are fed a constant flow of pressurized oil through pressurized oil inlets 86 and each distribute its pressurized oil to four, equally circumferentially spaced and radially extending oil bearing pads 88 which preferably merely consists of openings. The oil bearing pads 88 open against the outer circumferential surface of the connecting pin 78 and direct the pressurized oil between the confronting surfaces of the connecting pin 78 and the drive rod 80 thereby creating a constantly pressurized and constantly flowing oil film at all times between such surfaces to, in turn, serve as a sophisticated bearing for the pivotal movement between the surfaces.

It should be understood that in the hydrostatic oil bearing assembly 82 between the connecting pin 78 and the rearward end of the drive rod 80 as hereinbefore described, and is true of other hydrostatic oil bearing assemblies of other components to be hereinafter described, there is a constantly pressurized and constantly flowing oil film created at the particular confronting surfaces from outside oil pressure distributed thereto on this constantly flowing basis. Furthermore, the constant oil flow creating the constantly pressurized and flowing oil film between the component surfaces is regulated as to flow rate and pressure in known manner so that the moving connection between the components, whether pivotal, rotative or linearly sliding, tends to be self centering, as well as compensating for misalignment forces applied from time to time against the components during their movements, all in well known hydrostatic oil bearing fashion. Still further, as is characteristic of hydrostatic oil bearings generally, the oil film suspension produced is not dependent on relative motion between the coacting and spaced surfaces of the components, but will rather be present whether these surfaces are stationary or moving relative to each other. This hydrostatic-type pressurized oil film suspension between the confronting surfaces should be differentiated from the usual form of hydrodynamic bearings wherein a thickened film of oil is dependent on the movement and speed between the confronting surfaces and wherein a decrease in the relative speeds between the surfaces will cause a sinking of the oil film causing at least periodic metal-to-metal contact, proper hydrostatic oil bearings never permitting such metal-to-metal contact.

Figure 13:
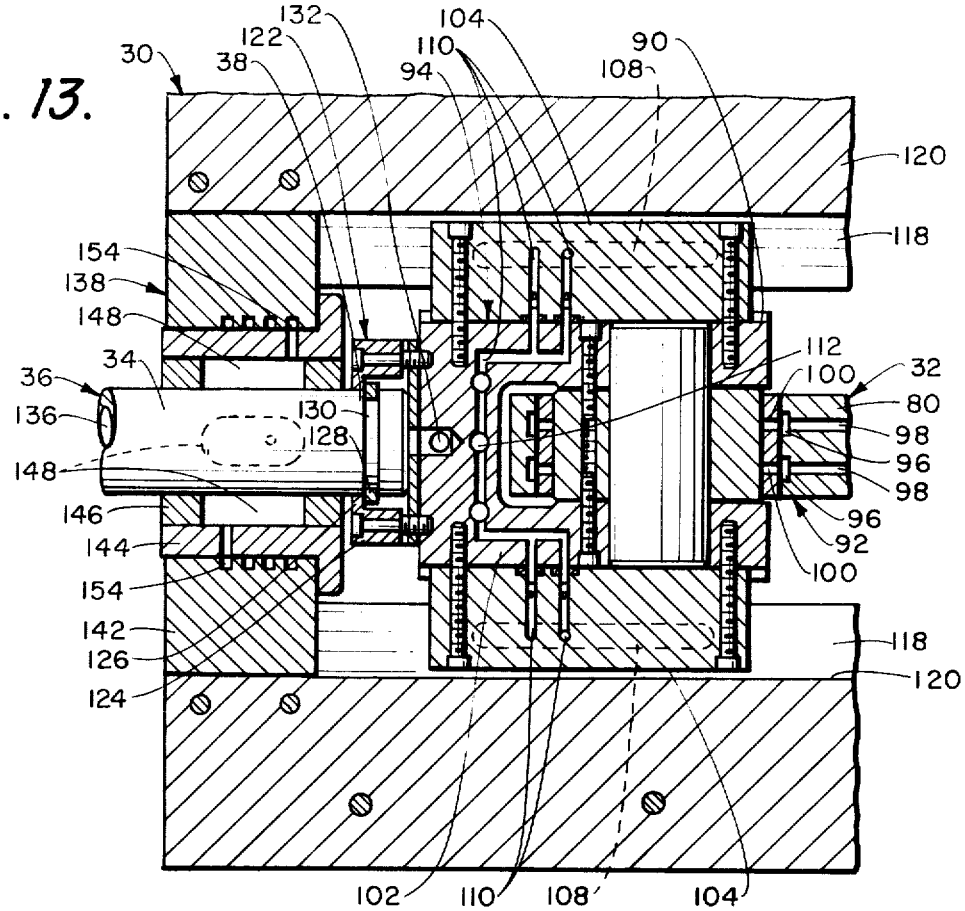
FIG. 13 is a fragmentary, horizontal sectional view looking in the direction of the arrows 13—in FIG. 10 and more clearly illustrating both the first embodiment of the oil bearing slide and the first embodiment of the drive connection means.
Figure 12:
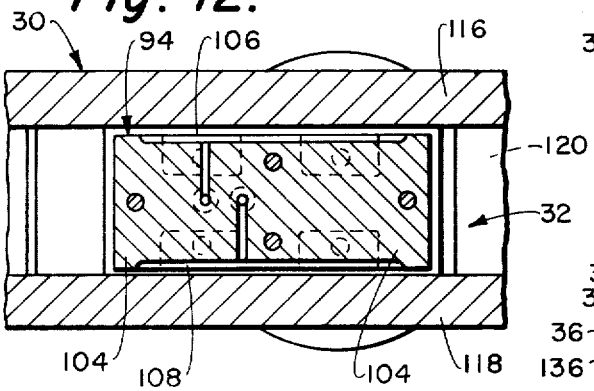
FIG. 12 is a fragmentary, vertical sectional view looking in the direction of the arrows 12—12 in FIG. 11.

A forward end of the drive rod 80, as is best seen in FIGS. 8, 9 and 13, is pivotally connected to a connecting pin assembly 90 by means of a quite similar hydrostatic oil bearing assembly generally indicated at 92, the connecting pin assembly 90 being secured to a hydrostatic oil bearing slide assembly generally indicated at 94 to be later described in detail. Again, the hydrostatic oil bearing assembly 92 between the forward end of the drive rod 80 and the connecting pin assembly 90 is primarily in the drive rod including transversely spaced, annular, pressurized oil distribution channels 96 receiving a constant flow of constantly pressurized oil from pressurized oil inlets 98 and distributing such oil to equally circumferentially spaced oil bearing pads 100 opening radially inwardly against the outer surface of the connecting pin assembly 90. The pressurized oil inlets 98 receive their constant supply of pressurized oil from the pressurized oil distribution channels 84 of the previously described hydrostatic oil bearing assembly 82 through the drive rod 80 as shown and, as before, the oil bearing pads 100 distribute and maintain a constantly pressurized and constantly flowing oil film between the confronting surfaces of the drive rod 80 and the connecting pin assembly 90 to, in turn, permit the non-metal-contacting relative pivotal movement.

The hydrostatic oil bearing slide assembly 94 is best seen in FIGS. 8, 9 and 11 through 13, this being a first embodiment of such slide assembly. Referring to the drawings indicated, the hydrostatic oil bearing slide assembly 94 includes a generally rectangularly sided main frame 102 having oppositely transversely projecting guides 104, each guide having vertically upwardly and downwardly directed and opening, elongated oil bearing pads 106 and 108. The oil bearing pads 106 and 108 are fed a constant supply of constantly pressurized and constantly flowing oil through a series of pressurized oil supply lines 110 formed within the main frame 102 and continuing into the respective guides 104 to the appropriate oil bearing pads. The pressurized oil supply lines 110 receive their supply of pressurized oil from a main pressurized oil inlet 112, and it will be noted that this main pressurized oil inlet also provides the oil supply for the previously described hydrostatic oil bearing assemblies 82 and 92 through appropriate distribution lines 114 between the pressurized oil supply lines 110 and the hydrostatic oil bearing assembly 82 (FIG. 8).

In the assembly with the bodymaker 30, each of the guides 104 of the hydrostatic oil bearing slide assembly 94 projects transversely between forwardly and rearwardly elongated, stationary, upper and lower, horizontal slide plates 115 and 118 secured to the bodymaker. Confronting surfaces of the guides 104 and the slide plates 116 and 118 are spaced apart an appropriate distance so that the constantly pressurized and constantly flowing oil from the oil bearing pads 106 and 108 produce the constantly pressurized oil film between the confronting surfaces of the forwardly and rearwardly moving guides 104 and the stationary horizontal slide plates 116 and 118 thereby vertically bearing guiding the hydrostatic oil bearing slide assembly 94 forwardly and rearwardly on the bodymaker 30. The outer edges of the guides 104 are at all times horizontally spaced from vertical slide plates 120, but in this first embodiment construction of the hydrostatic oil bearing slide assembly, no bearings are provided at these locations and assembly alignments are depended upon for maintaining the proper horizontal alignment of the hydrostatic oil bearing slide assembly in its forward and rearward sliding movement.

The hydrostatic oil bearing slide assembly 94 forms the basic forward end terminus of the drive mechanism 32 and this slide assembly is operably connected to the rearward end 34 of the ram 36 by a first embodiment of a drive connection means generally indicated at 122 as best seen in FIGS. 8, 9 and 13. The drive connection means 122 is the lesser sophisticated form of the present invention and includes a forwardly projecting gripping ring 124 secured to the hydrostatic oil bearing slide assembly 94 having a radially inwardly extending, annular gripping flange 126 at a forward end thereof forwardly overlying a radially outwardly extending collar 128 secured to the ram 36 by reception thereof into a ram annular groove 130. The gripping ring 124 with its gripping flange 126 is proportioned relative to the ram collar 128 and the location thereof so that the gripping ring clamps the collar and thereby the ram rearward end 34 rearwardly against a vertical surface of the hydrostatic oil bearing slide assembly 94. An air line 132 projects forwardly within the gripping ring 124 from the hydrostatic oil bearing slide assembly 94 and from an air supply inlet 134 of the slide assembly (FIG. 9) into communication with a hollow interior 136 of the ram 36, the air supply being for a purpose not of importance to the present invention.

Figure 10:
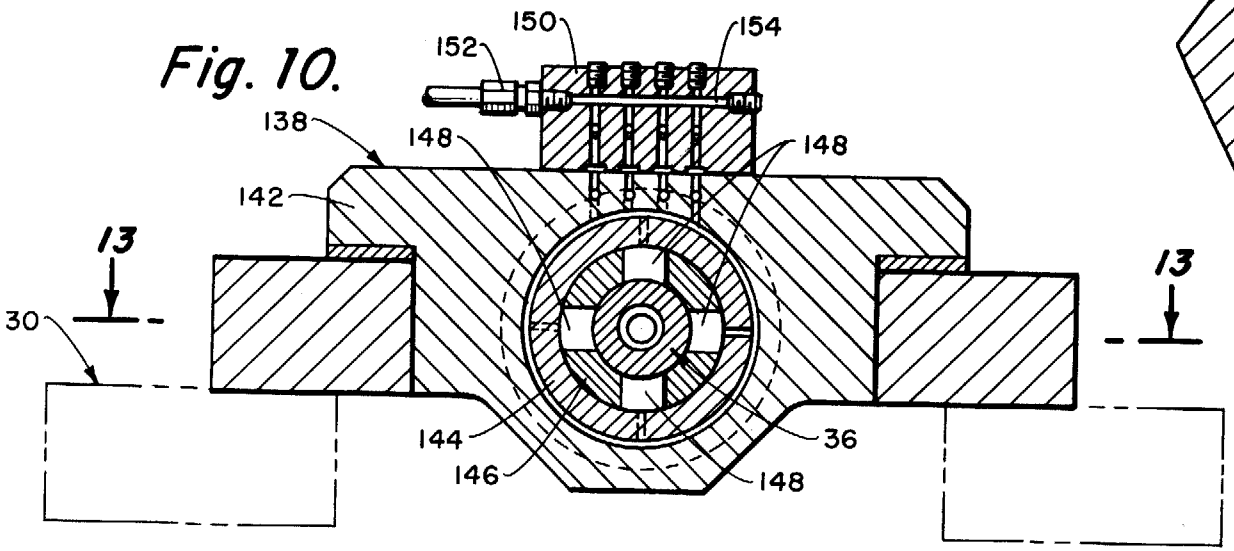
FIG. 10 is an enlarged, fragmentary, vertical sectional view looking in the direction of the arrows 10—10 in FIG. 9.

The ram 36 is mounted reciprocally movable in its forward and rearward strokes by a pair of axially spaced hydrostatic oil bearing sleeve assemblies generally indicated at 138 and 140, each of which is secured to the bodymaker 30 in such axially spaced relationship as somewhat functionally shown in FIGS. 3 through 6, and more in detail in FIGS. 8 through 10 and 13. The rearward hydrostatic oil bearing sleeve assembly 138 includes a mounting frame 142 secured stationary on the bodymaker 30 and, in turn, telescoping and securing a mounting sleeve 144. The mounting sleeve 144 further, in turn, telescopically mounts and secures a bearing sleeve 146 slideably receiving the ram 36 therethrough and having preferably four, equally circumferentially spaced and axially elongated oil openings or bearing pads 148 radially therethrough between the mounting sleeve and the outer cylindrical surface of the ram. A manifold 150 is mounted on the mounting frame 142 and receives a constant flow of pressurized oil at an oil inlet 152 distributing the pressurized oil through four oil supply lines 154, one oil supply line to each of the bearing pads 148 in the bearing sleeve 146 as best seen in FIGS. 9, 10 and 13.

The forward hydrostatic oil bearing sleeve assembly 140 is substantially the same as the rearward hydrostatic oil bearing sleeve assembly 138 so as to include a mounting frame 156 telescoping a mounting sleeve 158, in turn, telescoping a bearing sleeve 160 having the same pressurized oil openings or bearing pads 162. A same manifold 164 receives a constant flow of pressurized oil through an oil inlet 166 and distributes it through four oil supply lines 168 to the bearing pads 162, again against the outer cylindrical surface of the ram 36 slideably received therethrough. A wiper seal assembly generally indicated at 170 of known form may be integrated with the forward hydrostatic oil bearing sleeve assembly 140 projecting forwardly thereof and having the general function of wiping the outer circumferential surface of the ram 36 at this location as the ram moves forwardly and rearwardly therethrough to maintain separation between the bearing pressurized oil rearwardly thereof and metal forming fluids applied forwardly thereof, particularly in the die assembly 40, all in well known manner.

Thus, each of the oil bearing pads 148 and 162 of the hydrostatic oil bearing sleeve assemblies 138 and 140 distribute a constant flowing supply of pressurized oil against the outer cylindrical surface of the ram 36 resulting in a constantly flowing pressurized oil film at all times between the bearing sleeves 146 and 160 and the ram outer surface to thereby maintain alignment and support of the ram at all times during its forward and rearward reciprocal strokes at bodymaker spaced axial locations. Due to the axial spacing of the hydrostatic oil bearing sleeve assemblies 138 and 140, this not only maintains excellent support and alignment for the ram during these movements and without metal-to-metal contact, but also effectively isolates the ram for such support and alignment from the remainder of the bodymaker 30 except for these bearing sleeve assemblies, the degree of ram isolation being determined to a certain extent by the particulars of the drive connection means 122 between the ram rearward end 34 and the drive mechanism 32 or the hydrostatic oil bearing slide assembly 94 of such drive mechanism. In other words, with a maximum axial spacing of the hydrostatic oil bearing sleeve assemblies 138 and 140 for a given forward and rearward stroke of the ram 36, that is, with the rearward bearing sleeve assembly 138 only slightly forwardly of the maximum forward movement of the drive connection means 122 and the forward bearing sleeve assembly 140 only spaced rearwardly from the die assembly 40 a minimum distance to permit proper feeding of the starting shallow cup blanks 42 with operation of the appropriate mechanisms for initial positioning thereof, the maximum ram isolation results will be obtained for a given drive connection means 122 between the ram 36 and the drive mechanism 32 with the drive mechanism being relegated to primarily merely supplying forward and rearward driving forces for the ram.

Stated simply, it is the primary function of the spaced hydrostatic oil bearing sleeve assemblies 138 and 140 to support and maintain moving alignment of the ram 36 and in doing so, to maximize the isolation of the ram for this support and alignment from the remainder of the bodymaker 30, thereby isolating or relegating the drive mechanism 32 to the greatest possible extent to the function of solely providing forward and rearward driving forces for the ram. The degree that such isolation of the ram 36 is accomplished will be determined by the flexibility of the drive connection means 122 between the ram rearward end 34 and the forward terminus of the drive mechanism 32 which, in this particular embodiment, is the hydrostatic oil bearing slide assembly 94, and where the drive connection means 122 is of minimum or little flexibility, the moving alignment of the forward terminus of the drive mechanism or the hydrostatic oil bearing slide assembly with the forwardly and rearwardly moving ram. However, with the ram 36 supported on and maintained aligned by the forwardly positioned, spaced, hydrostatic oil bearing sleeve assemblies 138 and 140, and the drive connection means 122 connecting the ram to the drive mechanism 32 always being rearwardly thereof, as long as the forward terminus of the drive mechanism is always maintained in its movements relatively closely aligned with the movements of the ram, a majority of the ram will always be isolated in function from the drive mechanism and thereby the remainder of the bodymaker regardless of the form of the drive connection means 122, particularly the forward portion of the ram including the working forward end portion 38 thereof.

Figure 3:
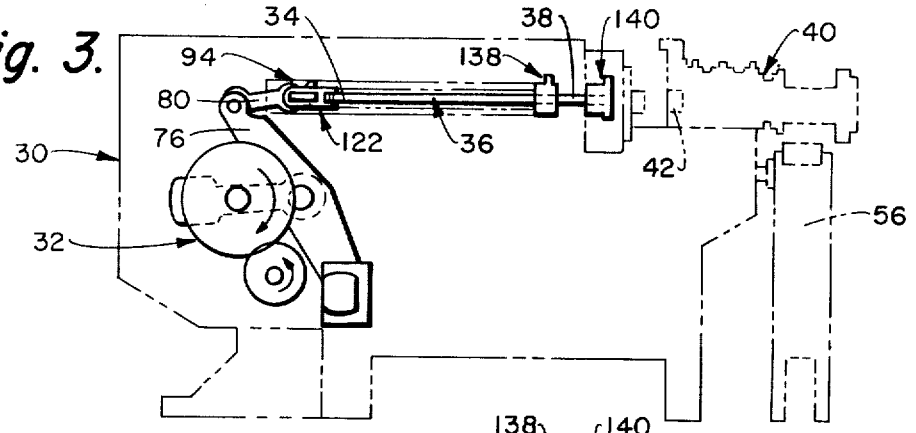
FIGS. 3 through 6 are somewhat diagrammatic views of the bodymaker of FIG. 1 showing the progressive stages of movement of the drive mechanism and ram during the bodymaker formation of a metal cup blank into a can body with use of the ram support and drive improvements of the present invention.
Figure 4:
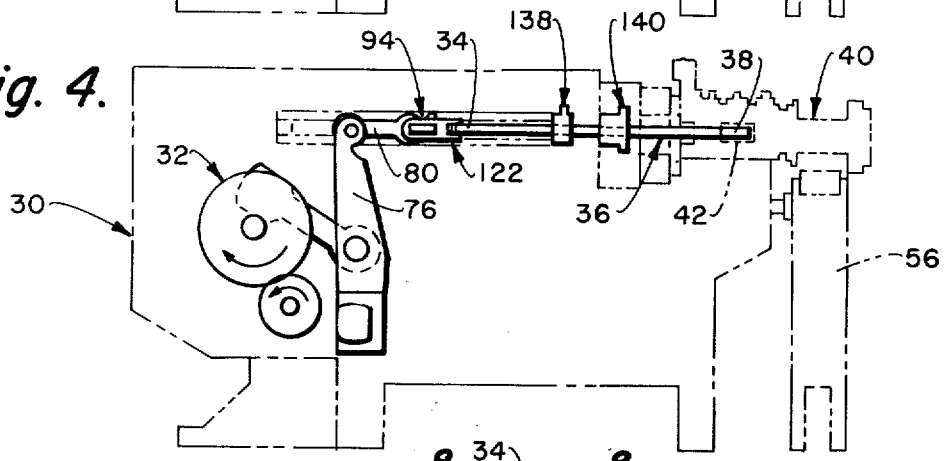
Figure 5:
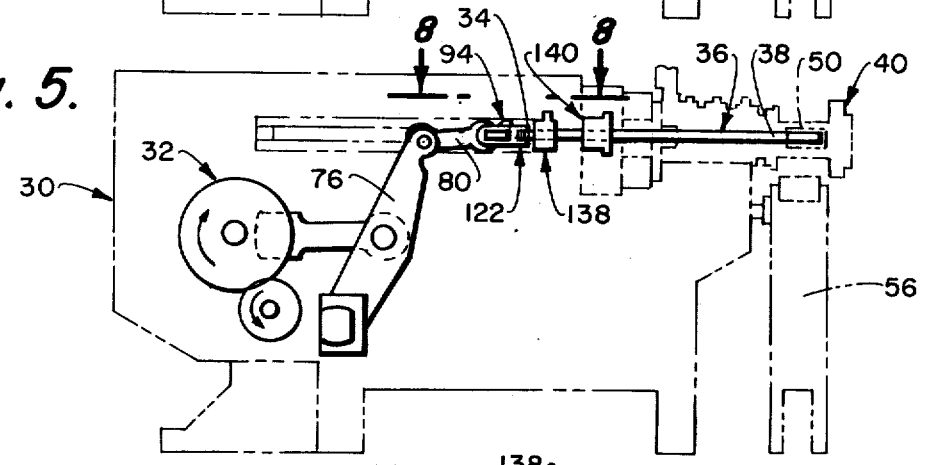
Figure 6:
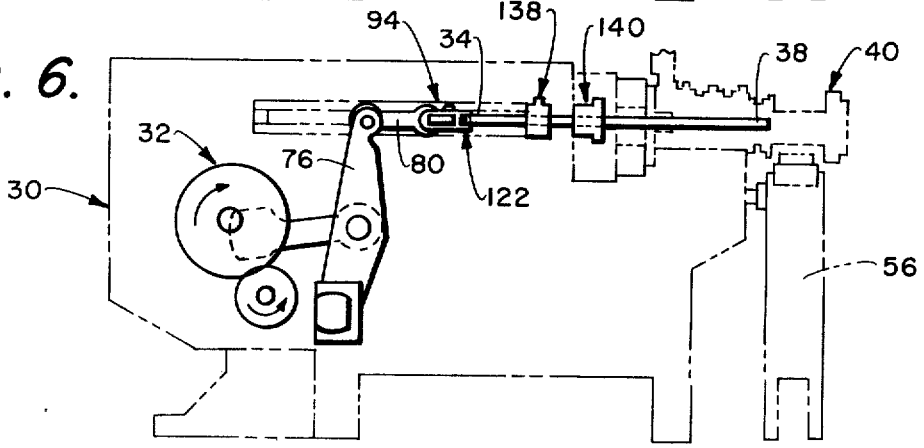
Figure 7:
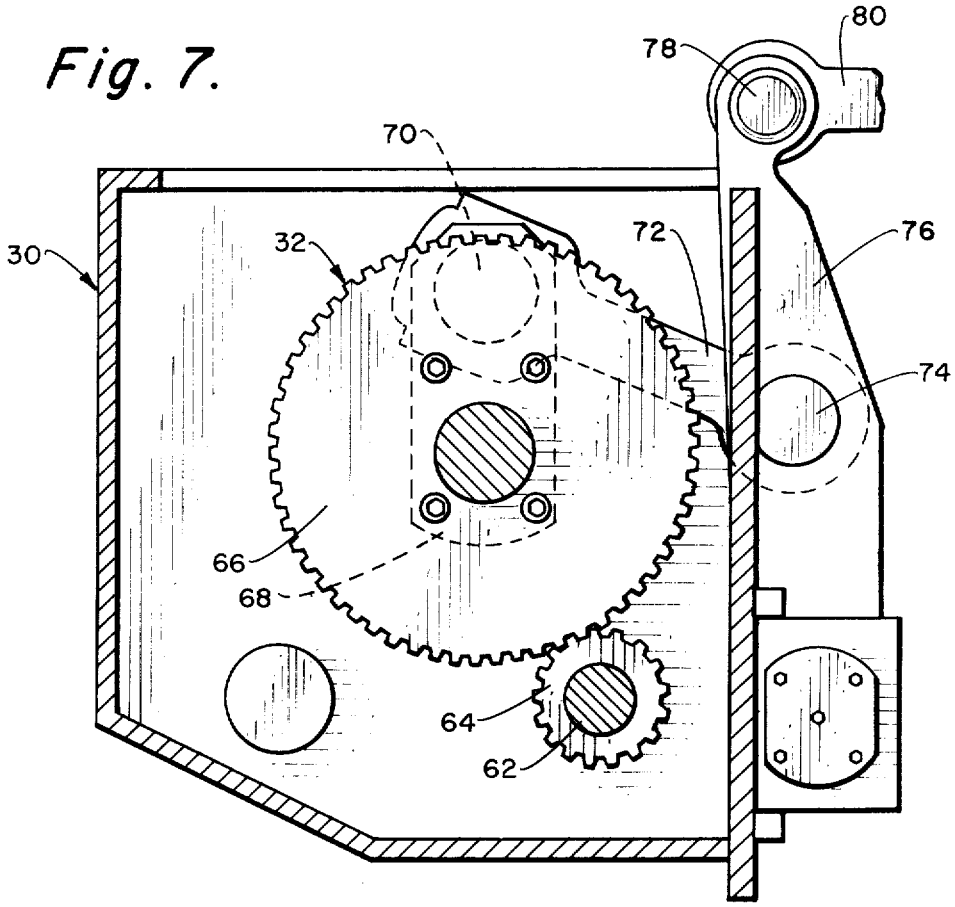
FIG. 7 is an enlarged, fragmentary, vertical sectional view of the bodymaker drive mechanism.
Figure 11:
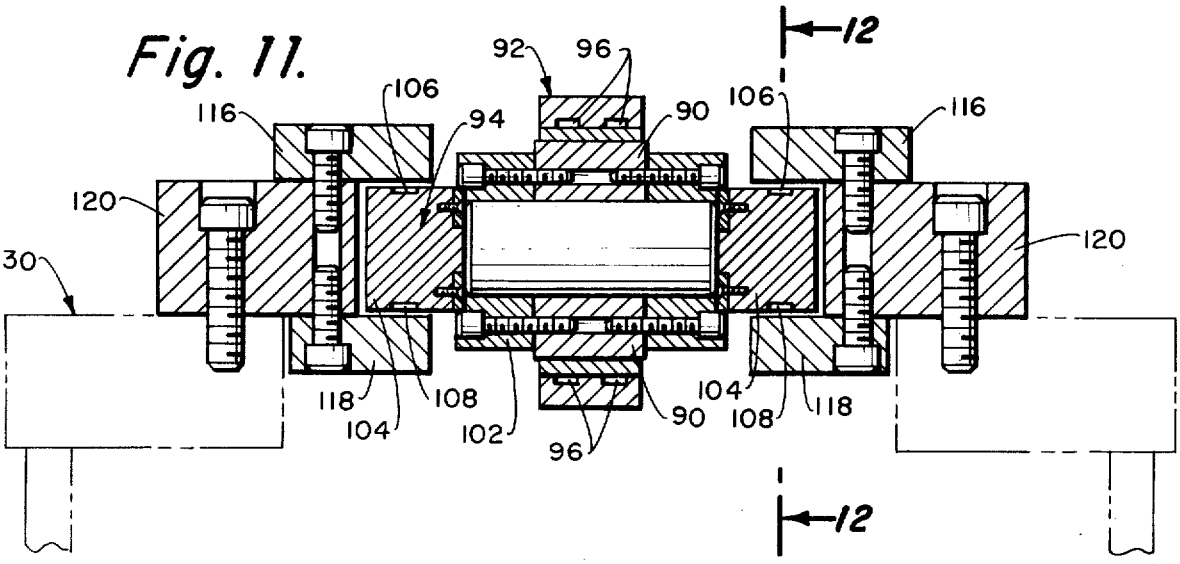
FIG. 11 is an enlarged, fragmentary, vertical sectional view looking in the direction of the arrows 11—11 in FIG. 8 and more clearly illustrating the first embodiment of the oil bearing slide.

As can be seen in FIG. 3, when the ram 36 is at the rearward end of its rearward stroke and just commencing its forward stroke, a maximum rearward portion of the ram is rearwardly of its isolating hydrostatic oil bearing sleeve assemblies 138 and 140 so that any misalignments between the ram and the forward terminus of the drive mechanism 32 would have the greatest effect on the ram, but in this position, the ram would not be in a functioning portion of its stroke which would require the maximum of alignment with the die assembly 40. As the ram 36 proceeds in its forward stroke ultimately entering the die assembly 40 as shown in sequence in FIGS. 4 and 5, the actual working portion of the ram stroke, the forward terminum of the drive mechanism 32 is progressively moving forwardly nearer and nearer to the ram isolating hydrostatic oil bearing sleeve assemblies 138 and 140 and, at the same time, the forward portion of the ram is progressively moving further forwardly of its isolating support. As a result, any slight misalignment between the ram 36 as primarily determined by the isolating hydrostatic oil bearing sleeve assemblies 138 and 140 and the forward terminus of the drive mechanism 32 will have lesser and lesser effect on the forward functioning portion of the ram so that for all important purposes, with the ram isolating structure above described and with the usual relatively close alignment of bodymakers of the type herein involved, a majority of the ram will be maintained isolated for its support and alignment from the remainder of the bodymaker regardless of the flexibility of the drive connection means 122.

Returning to the particulars of the structure shown in FIGS. 1 through 13 including the first embodiment of the hydrostatic oil bearing slide assembly 94 and the first embodiment of the drive connection means 122, with the clamping ring 124 exerting maximum clamping pressure tightly clamping the rearward end 34 of the ram 36 against the hydrostatic oil bearing slide assembly 94, as long as the forward and rearward movements of the hydrostatic oil bearing slide assembly are relatively closely aligned with the forward and rearward movements of the ram, at least a majority of the ram will be maintained isolated from the drive mechanism 32. This will mean that the ram 36 will primarily be supported and maintained aligned by the hydrostatic oil bearing sleeve assemblies 138 and 140 with the drive mechanism 32 being primarily for providing forward and rearward driving motion to the ram. Furthermore, some slight flexibility of movement between the ram 36 and the drive mechanism 32 may be provided by slight loosening of the gripping ring 124 of the drive connection means 122, thereby slightly relieving the clamping pressure between the ram 36 and the drive mechanism 32 for some freedom of relative motion although other embodiments of the drive connection means to be hereinafter described are more appropriate for such increased flexibility and increased ram isolation.

It is pointed out that in all instances of the hydrostatic oil bearings as hereinbefore described including the hydrostatic oil bearing assemblies 82 and 92 for the drive rod 80, the hydrostatic oil bearing slide assembly 94 and the hydrostatic oil bearing sleeve assemblies 138 and 140, the constantly flowing and constantly pressurized oil supplies, after creating the functioning pressurized oil films, flow axially free of the oil bearing assemblies and drop downwardly by gravity to an underlying sump (not shown) of the bodymaker 30 where the oil is filtered and then returned to the oil bearings, all in well known manner. The same is true of the metal forming fluids provided forwardly for the die assembly 40, such metal forming fluids, of course, being kept separate from the oil of the oil bearings. The mixtures of the oil of the oil bearings and the metal forming fluids collected from the outer surface of the ram 36 at the wiper seal assembly 170 are disposed of in usual manner.

Figure 14:
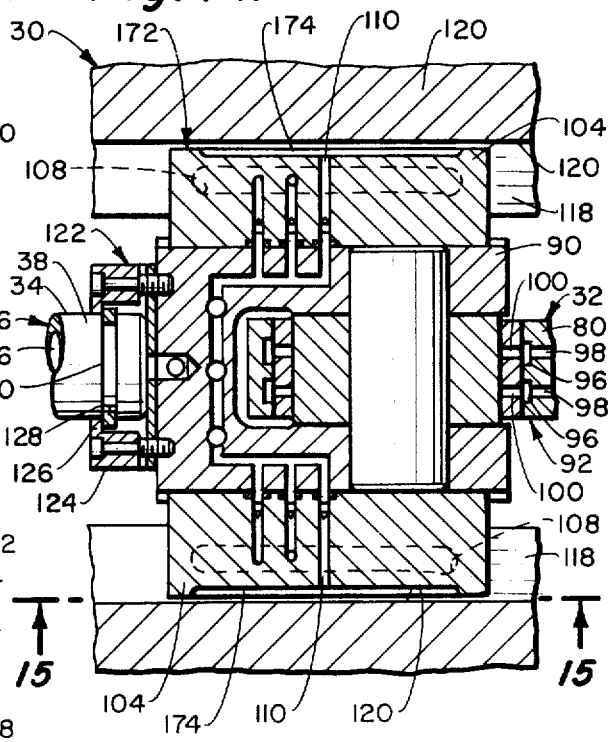
FIG. 14 is a view similar to FIG. 13, but illustrating a second embodiment of the oil bearing slide forming a part of the drive mechanism.
Figure 15:
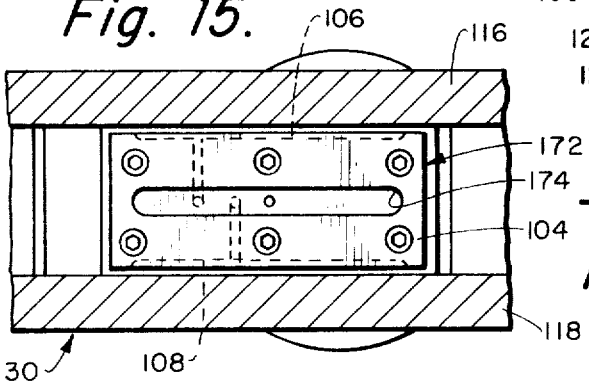
FIG. 15 is a fragmentary, vertical sectional view looking in the direction of the arrows 15—15 in FIG. 14.

A second embodiment hydrostatic oil bearing slide assembly generally indicated at 172 is shown in FIGS. 14 and 15 and is substantially identical to the hydrostatic oil bearing slide assembly 94 forming the forward terminus of the drive mechanism 32 except for the addition of horizontally oppositely directed oil bearing pads giving more positive horizontal alignment. As shown, each of the guides 104 has an axially elongated oil bearing pad 174 at its side edge vertical surface facing its respective vertical slide plate 120 and receiving the constant flow of pressurized oil through appropriate additional pressurized oil supply lines 110 in similar manner to the other oil bearing pads 106 and 108. In this embodiment, this hydrostatic oil bearing slide assembly 172 is shown still operably connected to the ram rearward end 34 by the least sophisticated drive connection means 122, but these additional horizontally directed and stabilizing oil bearing pads 174 will increase the movement stability and alignment of the hydrostatic oil bearing slide assembly so that the forward terminus of the drive mechanism 32 represented by this bearing slide assembly may be maintained in increased uniform alignment with the ram 36 to increase the ram isolating capabilities of the hydrostatic oil bearing sleeve assemblies 138 and 140.

Second, third, fourth and fifth embodiments of the drive connection means 122 between the rearward end 34 of the ram 36 and the forward terminus of the drive mechanism 32, in this case, the hydrostatic oil bearing slide assembly 94, are shown in FIGS. 15 through 23 and each embodiment will be discussed separately below. However, in each of these drive connection means further embodiments, the particular drive connection means form is a universal drive connection means permitting the transmission of pure forward and rearward driving motion between the drive mechanism 32 and the ram 36 while having sufficient flexibility to essentially eliminate the effect of any misalignments throughout such forward and rearward motions therebetween. The second embodiment is, therefore, more sophisticated than the first embodiment described above, while the third, fourth and fifth embodiments are even more sophisticated, but common to all, they are still reasonably simple constructions which may be provided for relatively minimum increased cost.

Figure 16:
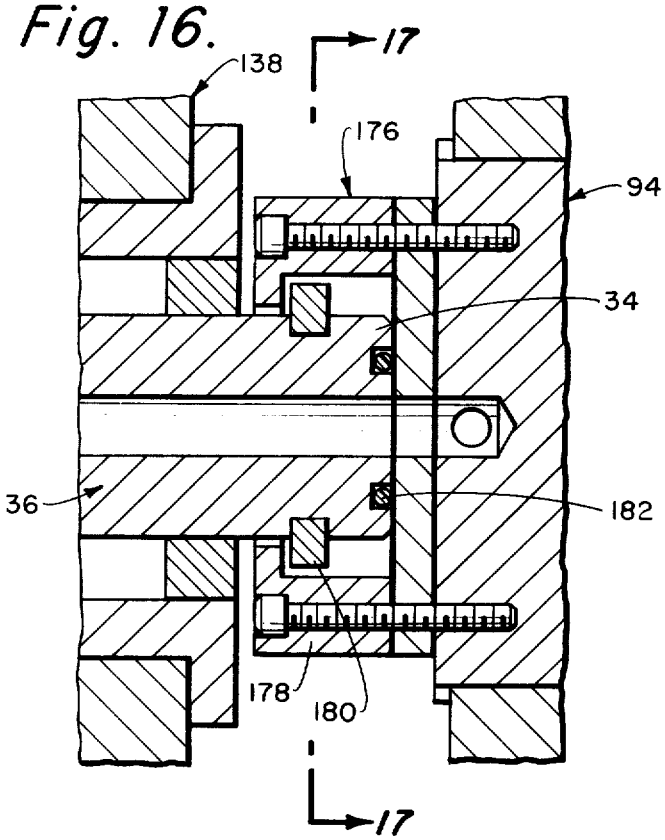
FIG. 16 is an enlarged, fragmentary, horizontal sectional view similar to FIG. 13, but illustrating a second embodiment of the drive connection means between the drive mechanism and the ram.
Figure 17:
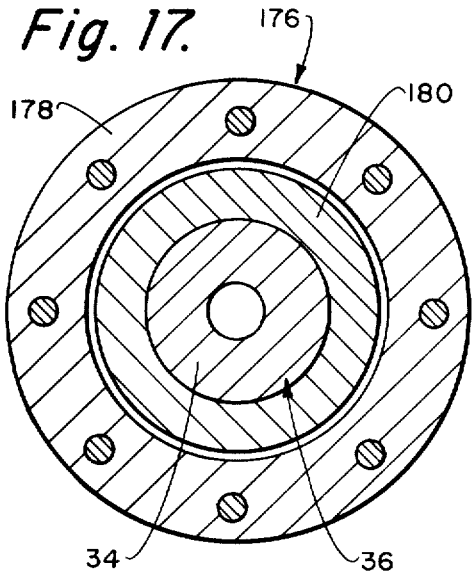
FIG. 17 is a vertical sectional view looking in the direction of the arrows 17—17 in FIG. 16.

Referring to FIGS. 16 and 17, a second embodiment drive connection means generally indicated at 176 is shown which is quite similar to the first embodiment with the addition that a gripping ring 178 is secured to the hydrostatic oil bearing slide assembly 94 of a predetermined set axial length proportioned to the spacing of a radial collar 180 of the ram 36 from the ram rearward end 34 so that slight looseness or play between the ram and gripping collar is always permitted. Although the various spacings are somewhat exaggerated for ilustration purposes, note that the radial spacing between the ram radial collar 180 and the gripping ring 178 permits relative radial movement and the spacing forwardly of the ram radial collar and rearwardly of the gripping ring permits both relative axial movement as well as combinations of radial and axial movement involved in universal movement. Clearances created at the ram rearward end 34 may be compensated for in usual manner by a resilient O-ring 182 so that air transmission into the ram 36 as previously described is not disturbed.

Figure 18:
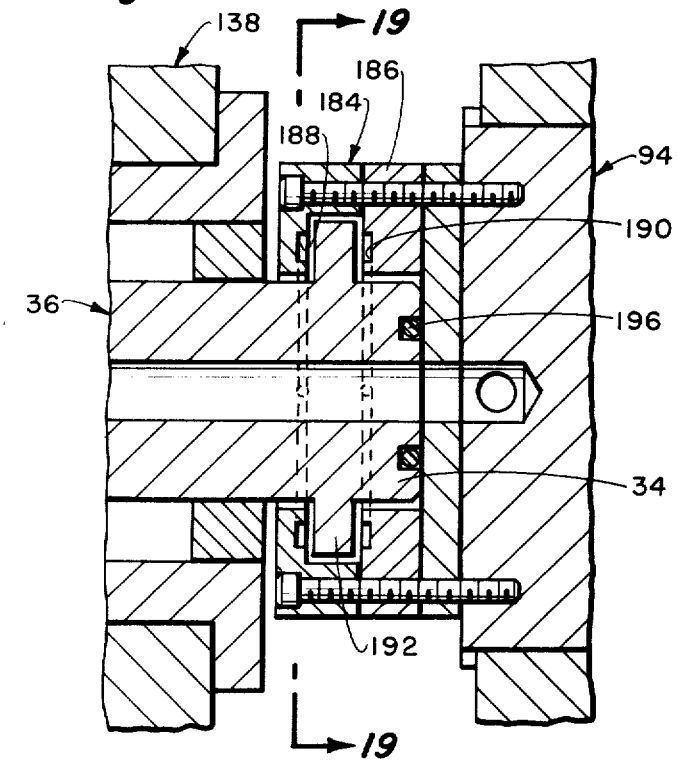
FIG. 18 is a view similar to FIG. 16, but illustrating a third embodiment of the drive connection means between the drive mechanism and the ram.
Figure 19:
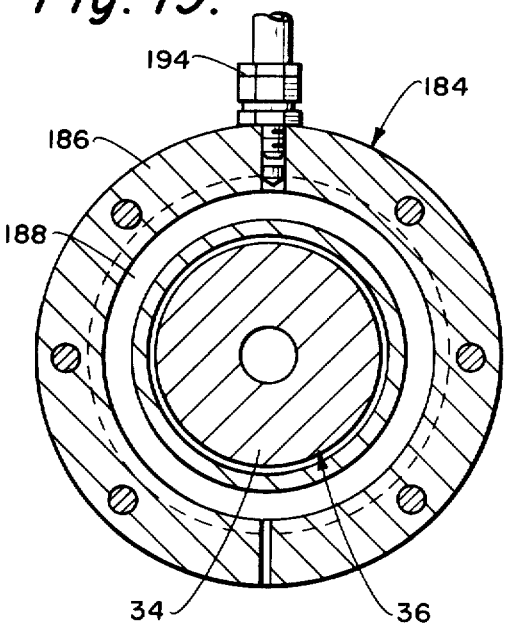
FIG. 19 is a fragmentary, vertical sectional view looking in the direction of the arrows 19—19 in FIG. 18.

Referring to FIGS. 18 and 19, a third embodiment drive connection means generally indicated at 184 includes a hydrostatic oil bearing ring 186 secured to the hydrostatic oil bearing slide assembly 94 and having a rearwardly directed, annular, oil bearing pad 188 and a forwardly directed, annular, oil bearing pad 190 which respectively face confronting surfaces of a radial collar 192 of the ram 36. Thus, constantly flowing pressurized oil films created between the hydrostatic oil bearing ring 186 and the radial collar 192 by a constant supply of pressurized oil from an oil inlet 194 to the oil bearing pads 188 and 190 permit the universal motion between the hydrostatic oil bearing slide assembly 94 and the ram 36, that is, by proper pressure regulation of the constantly flowing oil combined with the motion permitting clearances. Movements of the ram rearward end 34 are again compensated for by a resilient O-ring 196.

Figure 20:
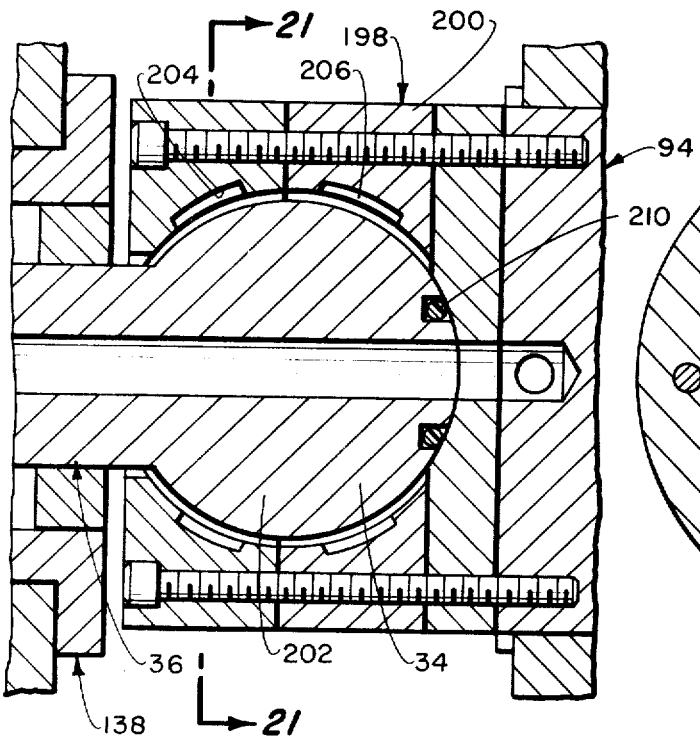
FIG. 20 is view similar to FIG. 16, but illustrating a fourth embodiment of the drive connection means between the drive mechanism and the ram.
Figure 21:
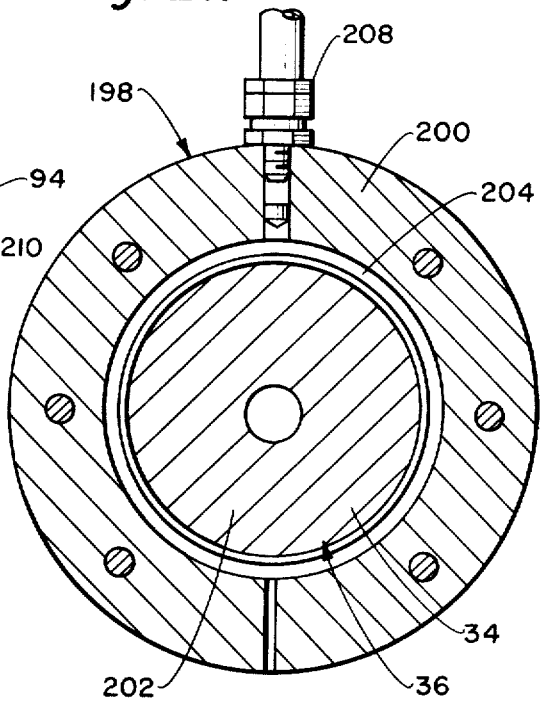
FIG. 21 is a fragmentary, vertical sectional view looking in the directions of the arrows 21—21 in FIG. 20.
Figure 22:
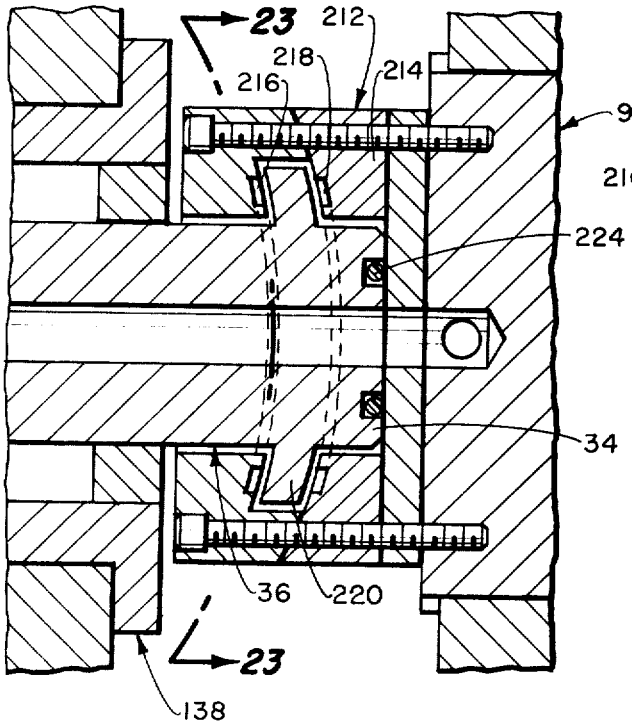
FIG. 22 is a view similar to FIG. 16, but illustrating a fifth embodiment of the drive connection means between the drive mechanism and the ram.
Figure 23:
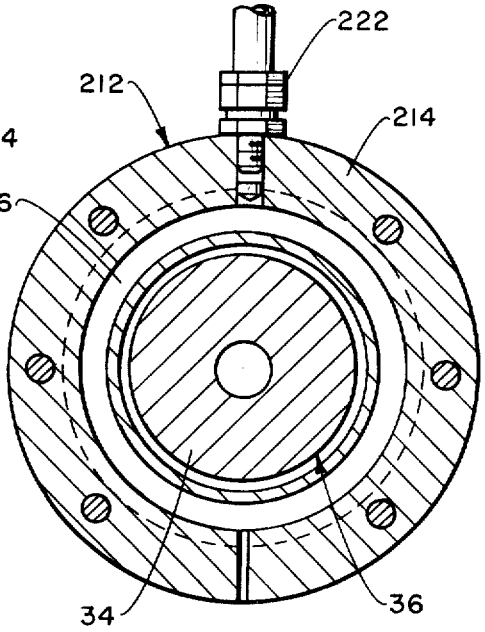
FIG. 23 is a fragmentary, vertical sectional view looking in the direction of the arrows 23—23 in FIG. 22.

In the fourth embodiment shown in FIGS. 20 and 21, a drive connection means generally indicated at 198 includes a hydrostatic oil bearing ring 200 secured to the hydrostatic oil bearing slide assembly 94 and having a spherically formed inner cavity receiving a spherical collar 202 projecting both radially and axially rearwardly forming the rearward end of the ram 36. Angularly directed, annular forward and rearward oil bearing pads 204 and 206 create the constantly flowing pressurized oil films over the ram spherical collar 202 receiving pressurized oil from an oil inlet 208 to thereby permit the universal motion between the drive mechanism 32 and the ram 36. As before, a resilient O-ring 210 compensates for the relative movements.

Finally, a fifth embodiment drive connection means generally indicated at 212 includes a hydrostatic oil bearing ring 214 secured to the hydrostatic oil bearing slide assembly 94 having annular, rearwardly and forwardly directed, oil bearing pads 216 and 218 facing arcuate and radially extending or spherically extending surfaces of a radial collar 220 on the ram 36. The oil bearing pads 216 and 218 each receive a constant flow of pressurized oil from a pressurized oil inlet 222 and create the constantly flowing pressurized oil films between the hydrostatic oil bearing ring 214 and the ram radial collar 220 for the universal motion therebetween. The resilient O-ring 224 maintains the ram rearward end 34 sealed as before during such movement.

According to the principles of the present invention, therefore, the horizontally reciprocal ram 36 having the forward end portion 38 thereof moving forwardly and rearwardly through the die assembly 40 carrying one of the shallow cup blanks 42 forwardly therewith for forming the same in the die assembly into one of the can bodies is maintained supported and aligned in its reciprocations isolated on the bodymaker 30 by relatively centrally located, axially spaced hydrostatic oil bearing sleeve assemblies 138 and 140. Such isolation of the ram 36 during its forward and rearward reciprocal movement by the hydrostatic oil bearing sleeve assemblies 138 and 140 means that the stationary supporting sleeve assemblies are primarily depended upon for such ram support and alignment eliminating any further required support and alignment including moving ram support at the ram rearward end 34 as was formerly required in the prior construction. This ram isolation also means that the bodymaker drive mechanism 32 is primarily relegated to the sole function of providing forward and rearward driving forces for the ram.

Even in the least sophisticated of the drive connection means between the forward terminus of the bodymaker drive mechanism 32 and the ram rearward end 34, the first embodiment drive connection means 122 assembled for tight clamping of the ram rearward end 34 against the first embodiment hydrostatic oil bearing slide assembly 94, a majority of the ram 36 will still be effectively isolated from the remainder of the bodymaker 30 and from most of the effects by the drive connection means 122. This is particularly true where the forward terminus of the drive mechanism 32, the first embodiment hydrostatic oil bearing slide assembly 94, is maintained relatively closely aligned in its forward and rearward movements with the ram forward and rearward movements and such maintaining of alignment can be further increased and simplified by use of the described second embodiment hydrostatic oil bearing slide assembly 172 wherein further oil bearing pads 174 are added. Where the mounting of the first embodiment drive connection means 122 is in the described slightly loosened form, the drive connection means begins to approach universal movement and begins to change the at least majority isolation of the ram closer to a virtually complete isolation of the ram from its forward and rearward driving force supplying drive mechanism 32.

Finally, the optimum form of the present invention is provided by use of the second, third, fourth and fifth embodiment drive connection means 176, 184, 198 and 212, all of which provide universal flexibility between the drive mechanism 32 and the ram rearward end 34. With this universal flexibility, the ram 36 is totally isolated for movement depending solely on the hydrostatic oil bearing sleeve assemblies 138 and 140 for its support and alignment, and the drive mechanism 32 solely provides the forward and rearward driving forces for the ram. The overall result, therefore, regardless of the particular embodiment or embodiments of the invention used, is increased simplicity and improved operating efficiency afforded to the moving ram 36 in its stationary support and maintenance of alignment, the elimination of certain massive drive mechanism components formerly required in similar bodymakers, and the possibility of increased speed of the strokes of the ram 36, if desired, while using less driving power for equivalent speeds, or the same driving power for greater speeds.

We claim:

1. In a can bodymaker and the like of the type having a drive mechanism operably connected to a rearward end of a horizontally reciprocal ram axially moving the ram forwardly through and rearwardly through and from a die assembly, the ram in its forward movement engaging a shallow metal cup blank over a ram forward end and carrying the blank forwardly through the die assembly converting the blank into a relatively deep cup-shaped can body; the improvements comprising: axially spaced and aligned hydrostatic oil bearing sleeves secured stationary on said bodymaker rearwardly of said die assembly and circumferentially surrounding said ram, said axially spaced bearing sleeves being between said die assembly and said drive mechanism connection to said ram rearward end in all positions of ram movement supporting said ram forward end movable in cantilever fashion projecting forwardly of said bearing sleeves progressively axially into and from said die assembly, said axially spaced bearing sleeves being the last effective alignment maintaining support of said ram forward end prior to entrance of said ram into and during withdrawal from said die assembly, said bearing sleeves having oil bearing pads directing constantly pressurized and flowing oil films against said ram maintaining with said bearing sleeve spacing said ram supported aligned with said die assembly in all positions of ram movement including said ram cantilever projection and a majority of said ram isolated as to said support and alignment from a remainder of said bodymaker in all positions of ram movement.

2. In a can bodymaker as defined in claim 1 in which said drive mechanism includes a hydrostatic oil bearing slide operably connected to said ram rearward end movable with said ram rearward end to and from said bearing sleeves rearwardly thereof and having oil bearing pads directing constantly pressurized and flowing oil films against stationary surfaces of said bodymaker supporting said slide in movement generally aligned with said ram.

3. In a can bodymaker as defined in claim 1 in which said drive mechanism includes a hydrostatic oil bearing slide operably connected to said ram rearward end movable with said ram rearward end to and from said bearing sleeves rearwardly thereof and having at least vertically opposed oil bearing pads directing constantly pressurized and flowing oil films against stationary confronting surfaces of said bodymaker supporting said slide in movement generally aligned with said ram.

4. In a can bodymaker as defined in claim 1 in which said drive mechanism includes a hydrostatic oil bearing slide operably connected to said ram rearward end movable with said ram rearward end to and from said bearing sleeves rearwardly thereof and having both vertically opposed and horizontally opposed oil bearing pads directing constantly pressurized and flowing oil films against stationary confronting surfaces of said bodymaker supporting said slide in movement generally aligned with said ram.

5. In a can bodymaker and the like of the type having a drive mechanism operably connected to a rearward end of a horizontally reciprocal ram axially moving the ram forwardly through and rearwardly through and from a die assembly, the ram in its forward movement engaging a shallow metal cup blank over a ram forward end and carrying the blank forwardly through the die assembly converting the blank into a relatively deep cup-shaped can body; the improvements comprising: axially spaced and aligned hydrostatic oil bearing sleeves secured stationary on said bodymaker rearwardly of said die assembly and circumferentially surrounding said ram, said bearing sleeves having oil bearing pads directing constantly pressurized and flowing oil films against said ram maintaining with said bearing sleeve spacing said ram supporting aligned with said die assembly in all positions of ram movement and a majority of said ram isolated as to said support and alignment from a remainder of said bodymaker in all positions of ram movement; said operable connection between said drive mechanism and said ram rearward end including drive connection means for transmitting forward and rearward driving axial forces between said drive mechanism and said ram while substantially eliminating all at least horizontally radial force transmission therebetween to aid said spaced bearing sleeves in said ram isolation as to support and alignment from a remainder of said bodymaker.

6. In a can bodymaker as defined in claim 5 in which said drive connection means includes universal drive connection means for transmitting forward and rearward driving axial forces between said drive mechanism and said ram while substantially eliminating all other force transmission therebetween to totally isolate said ram as to support and alignment from a remainder of said bodymaker other than said spaced bearing sleeves.

7. In a can bodymaker as defined in claim 5 in which said drive connection means includes a radially extending collar on said ram rearward end and certain confronting surfaces on said drive mechanism.

8. In a can bodymaker as defined in claim 5 in which said drive connection means includes universal drive connection means for transmitting forward and rearward driving axial forces between said drive mechanism and said ram while substantially eliminating all other force transmission therebetween to totally isolate said ram as to support and alignment from a remainder of said bodymaker other than said spaced bearing sleeves; and in which said universal drive connection means includes a radially extending collar on said ram rearward end and certain confronting surfaces on said drive mechanism.

9. In a can bodymaker as defined in claim 5 in which said drive connection means includes universal drive connection means for transmitting forward and rearward driving axial forces between said drive mechanism and said ram while substantially eliminating all other force transmission therebetween to totally isolate said ram as to support and alignment from a remainder of said bodymaker other than said spaced bearing sleeves; and in which said universal drive connection means includes a spherical collar forming said ram rearward end and a ram rearward end surface, collar confronting surfaces on said drive mechanism.

10. In a can bodymaker as defined in claim 5 in which said drive connection means includes universal drive connection means for transmitting forward and rearward driving axial forces between said drive mechanism and said ram while substantially eliminating all other force transmission therebetween to totally isolate said ram as to support and alignment from a remainder of said bodymaker other than said spaced bearing sleeves; and in which said universal drive connection means includes a radially extending collar on said ram rearward end having forwardly and rearwardly directed surfaces, corresponding rearwardly and forwardly directed collar confronting surfaces on said drive mechanism, hydrostatic oil bearing pads on said drive mechanism surfaces directing constantly pressurized and flowing oil films between said collar and drive mechanism surfaces.

11. In a can bodymaker as defined in claim 5 in which said drive connection means includes universal drive connection means for transmitting forward and rearward driving axial forces between said drive mechanism and said ram while substantially eliminating all other force transmission therebetween to totally isolate said ram as to support and alignment from a remainder of said bodymaker other than said spaced bearing sleeves; and in which said universal drive connection means includes a spherical collar forming said ram rearward end and a ram rearward end surface, collar confronting surfaces on said drive mechanism emcompassing said ram spherical collar at least radially of said ram rearward end, hydrostatic oil bearing pads on said collar confronting surfaces of said drive mechanism directing constantly pressurized and flowing oil films between said ram spherical collar and said collar confronting surfaces of said drive mechanism.

12. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; and in which said drive connection means is between said slide and said ram rearward end for transmitting forward and rearward driving axial forces between said slide and said ram while substantially eliminating all at least horizontal radial force transmission therebetween.

13. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; and in which said drive connection means includes universal drive connection means between said slide and said ram rearward end for transmitting forward and rearward driving axial forces between said slide and said ram while substantially eliminating all other force transmission therebetween to totally isolate said ram as to support and alignment from a remainder of said bodymaker other than said spaced bearing sleeves.

14. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; in which said drive connection means is between said slide and said ram rearward end for transmitting forward and rearward driving axial forces between said slide and said ram while substantially eliminating all at least horizontally radial force transmission therebetween; and in which said drive connection means includes a radially extending collar on said ram rearward end and certain confronting surfaces on said slide.

15. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; in which said drive connection means includes universal drive connection means between said slide and said ram rearward end for transmitting forward and rearward driving axial forces between said slide and said ram while substantially eliminating all other force transmission therebetween to totally isolate said ram as to support and alignment from a remainder of said bodymaker other than said spaced bearing sleeves; and in which said universal drive connection means includes a radially extending collar on said ram rearward end and certain confronting surfaces on said slide.

16. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; in which said drive connection means includes universal drive connection means between said slide and said ram rearward end for transmitting forward and rearward driving axial forces between said slide and said ram while substantially eliminating all other force transmission therebetween to totally isolate said ram as to support and alignment from a remainder of said bodymaker other than said spaced bearing sleeves; and in which said universal drive connection means includes a spherical collar forming said ram rearward end and a ram rearward end surface, collar confronting surfaces on said slide.

17. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; in which said drive connection means includes universal drive connection means between said slide and said ram rearward end for transmitting forward and rearward driving axial forces between said slide and said ram while substantially eliminating all other force transmission therebetween to totally isolate said ram as to support and alignment from a remainder of said bodymaker other than said spaced bearing sleeves; and in which said universal drive connection means includes a radially extending collar on said ram rearward end having forwardly and rearwardly directed surfaces, corresponding rearwardly and forwardly directed collar confronting surfaces on said slide, hydrostatic oil bearing pads on said slide surfaces directing constantly pressurized and flowing oil films between said collar and slide surfaces.

18. In a can bodymaker as defined in claim 5 in which said drive mechanism includes a hydrostatic oil bearing slide operably connected to said ram rearward end movable with said ram and having oil bearing pads directing constantly pressurized and flowing oil films against stationary surfaces of said bodymaker supporting said slide in movement generally aligned with said ram; in which said drive connection means includes universal drive connection means between said slide and said ram rearward end for transmitting forward and rearward driving axial forces between said slide and said ram while substantially eliminating all other force transmission therebetween to totally isolate said ram as to support and alignment from a remainder of said bodymaker other than said spaced bearing sleeves; and in which said universal drive connection means includes a spherical collar forming said ram rearward end and a ram rearward end surface, collar confronting surfaces on said slide encompassing said ram spherical collar at least radially of said ram rearward end, hydrostatic oil bearing pads on said collar confronting surfaces of said slide directing constantly pressurized and flowing oil films between said ram spherical collar and said collar confronting surfaces of said slide.

* * * * *